United States Patent [19]

Tamaki et al.

[11] Patent Number: 4,974,482

[45] Date of Patent: Dec. 4, 1990

[54] KEYBOARD FOR AN ELECTRONIC MUSIC SYSTEM

[75] Inventors: Takashi Tamaki; Yasutoshi Kaneko, both of Shizuoka, Japan

[73] Assignee: Yamaha Corporation, Hamamatsu, Japan

[21] Appl. No.: 383,068

[22] Filed: Jul. 21, 1989

[30] Foreign Application Priority Data

Jul. 22, 1988 [JP] Japan ..... 63-183300

[51] Int. Cl.[5] ..... G10H 1/34; G10H 3/06

[52] U.S. Cl. ..... 84/653; 84/724; 84/744

[58] Field of Search ..... 84/DIG. 7, 615, 644, 84/653, 655, 670, 678, 719, 720, 724, 742, 744, 745; 341/26, 27, 31

[56] References Cited

U.S. PATENT DOCUMENTS 4,744,281 5/1988 Isozaki ..... 84/602

4,768,412 9/1988 Sanderson ..... 84/DIG. 7

*Primary Examiner*—Philip H. Leung

*Assistant Examiner*—Brian Sircus

*Attorney, Agent, or Firm*—Burns, Doane, Swecker & Mathis

[57] ABSTRACT

An electronic keyboard system according to the present invention has a plurality of key sensor units associated with the keys, respectively, and the key sensor units are paired to form a plurality of sensor pairs to which bidirectional current driving units respectively supplies currents periodically changed in direction for selectively actuating the sensor units, so that the interconnections between the bidirectional current driving units and the sensor units are simplified, thereby decreasing the occupation area in the keyboard system.

7 Claims, 11 Drawing Sheets

| NT \ OCT | 1 | 2 | 3 | 4 | 5 | 6 | 7 | 8 |
|---|---|---|---|---|---|---|---|---|
| C# | 0 | 0 | 0 | 0 | 0 | 0 | 0 | 0 |
| D | 0 | 0 | 0 | 0 | 0 | 0 | 0 | 0 |
| D# | 0 | 1 | 0 | 0 | 0 | 0 | 0 | 0 |
| E | 1 | 0 | 0 | 0 | 0 | 0 | 0 | 0 |
| F | 0 | 0 | 0 | 0 | 0 | 0 | 0 | 0 |
| F# | 0 | 0 | 1 | 0 | 0 | 0 | 0 | 0 |
| G | 0 | 0 | 0 | 0 | 0 | 0 | 0 | 0 |
| G# | 0 | 0 | 0 | 0 | 0 | 0 | 0 | 0 |
| A | 0 | 0 | 0 | 1 | 0 | 0 | 0 | 0 |
| A# | 0 | 0 | 0 | 0 | 0 | 0 | 0 | 0 |
| B | 0 | 0 | 0 | 0 | 0 | 0 | 0 | 0 |
| C | 1 | 0 | 0 | 0 | 0 | 0 | 0 | 0 |

| NT \ OCT | 1 | 2 | 3 | 4 | 5 | 6 | 7 | 8 |
|---|---|---|---|---|---|---|---|---|
| C# | 0 | 0 | 0 | 0 | 0 | 0 | 0 | 0 |
| D | 0 | 0 | 0 | 0 | 0 | 0 | 0 | 0 |
| D# | 0 | 0 | 0 | 0 | 0 | 0 | 0 | 0 |
| E | 1 | 0 | 0 | 0 | 0 | 0 | 0 | 0 |
| F | 0 | 0 | 1 | 0 | 0 | 0 | 0 | 0 |
| F# | 0 | 0 | 0 | 0 | 0 | 0 | 0 | 0 |
| G | 0 | 0 | 0 | 0 | 0 | 0 | 0 | 0 |
| G# | 0 | 0 | 0 | 0 | 0 | 0 | 0 | 0 |
| A | 0 | 0 | 0 | 1 | 0 | 0 | 0 | 0 |
| A# | 1 | 0 | 0 | 0 | 0 | 0 | 0 | 0 |
| B | 0 | 0 | 0 | 0 | 0 | 0 | 0 | 0 |
| C | 1 | 0 | 0 | 0 | 0 | 0 | 0 | 0 |

FIG. 10

| NT \ OCT | 1 | 2 | 3 | 4 | 5 | 6 | 7 | 8 |
|---|---|---|---|---|---|---|---|---|
| C# | 0 | 0 | 0 | 0 | 0 | 0 | 0 | 0 |
| D | 0 | 0 | 0 | 0 | 0 | 0 | 0 | 0 |
| D# | 0 | 1 | 0 | 0 | 0 | 0 | 0 | 0 |
| E | 0 | 0 | 0 | 0 | 0 | 0 | 0 | 0 |
| F | 0 | 0 | 1 | 0 | 0 | 0 | 0 | 0 |
| F# | 0 | 0 | 1 | 0 | 0 | 0 | 0 | 0 |
| G | 0 | 0 | 0 | 0 | 0 | 0 | 0 | 0 |
| G# | 0 | 0 | 0 | 0 | 0 | 0 | 0 | 0 |
| A | 0 | 0 | 0 | 0 | 0 | 0 | 0 | 0 |
| A# | 1 | 0 | 0 | 0 | 0 | 0 | 0 | 0 |
| B | 0 | 0 | 0 | 0 | 0 | 0 | 0 | 0 |
| C | 0 | 0 | 0 | 0 | 0 | 0 | 0 | 0 |

FIG. 11

| CURRENT DRIVER / i | 101 | | 103 | | 105 | | 107 | | 109 | | 111 | |
|---|---|---|---|---|---|---|---|---|---|---|---|---|
| 1 | 1 | 0 | 0 | 0 | 0 | 0 | 0 | 0 | 0 | 0 | 0 | 0 |
| 2 | 0 | 1 | 0 | 0 | 0 | 0 | 0 | 0 | 0 | 0 | 0 | 0 |
| 3 | 0 | 0 | 1 | 0 | 0 | 0 | 0 | 0 | 0 | 0 | 0 | 0 |
| 4 | 0 | 0 | 0 | 1 | 0 | 0 | 0 | 0 | 0 | 0 | 0 | 0 |
| 5 | 0 | 0 | 0 | 0 | 1 | 0 | 0 | 0 | 0 | 0 | 0 | 0 |
| 6 | 0 | 0 | 0 | 0 | 0 | 1 | 0 | 0 | 0 | 0 | 0 | 0 |
| 7 | 0 | 0 | 0 | 0 | 0 | 0 | 1 | 0 | 0 | 0 | 0 | 0 |
| 8 | 0 | 0 | 0 | 0 | 0 | 0 | 0 | 1 | 0 | 0 | 0 | 0 |
| 9 | 0 | 0 | 0 | 0 | 0 | 0 | 0 | 0 | 1 | 0 | 0 | 0 |
| 10 | 0 | 0 | 0 | 0 | 0 | 0 | 0 | 0 | 0 | 1 | 0 | 0 |
| 11 | 0 | 0 | 0 | 0 | 0 | 0 | 0 | 0 | 0 | 0 | 1 | 0 |
| 12 | 0 | 0 | 0 | 0 | 0 | 0 | 0 | 0 | 0 | 0 | 0 | 1 |

FIG. 14

KEYBOARD FOR AN ELECTRONIC MUSIC SYSTEM

FIELD OF THE INVENTION

This invention relates to an electronic keyboard system and, more particularly, to key sensor units for detecting the key motions in the keyboard.

BACKGROUND OF THE INVENTION

In the electronic keyboard system known as, for example, a synthesizer or an automatic player system, key sensor units are provided in association with the key board, and the key sensor units respectively detects key motions in the keyboard for deciding on the notes assigned to the depressed keys as well as the key touches. These notes and the key touches are used for producing sounds in the synthesizer, or are memorized in an information storage of the automatic player system for reproducing the sounds. The synthesizer is well known in the art, and the automatic player system is, by way of example, disclosed in U.S. Pat. No. 4,744,281.

Conventionally, the key sensor units were formed by mechanical switches, however, the mechanical switches are not fit for accurate sensing and use for a prolonged period of time due to the physical contacts. For this reason, the mechanical switches tend to be replaced with optical key sensors in the electric keyboard system, and the optical key sensors are becoming majority in the automatic player system.

In the electronic keyboard system, the optical key sensors are respectively associated with keys, and are coupled in parallel to a controller through wirings. Upon depressing a key, the key motion is detected by the associated optical key sensor, and the optical key sensor produces electric signals representative of the note assigned to the depressed key and the key touch. The electric signal is relayed to the controller, and the controller fetches the data represented by the electric signals for processing.

However, a problem is encountered in the prior art electronic keyboard system in complexity of the wiring arrangement. This is because of the fact that the optical key sensors are coupled in parallel to the controller through the private wirings. The complex wirings occupies a large amount of space, and difficulties are experienced in fitting the optical key sensors and the wirings, because of the limitation in the space available for the installation.

Moreover, the wirings tends to be close one another, and, for this reason, an electromagnetic field induced around the wirings is much liable to be influence on the electric signals. This results in undesirable destruction of the data on the electric signals.

SUMMARY OF THE INVENTION

It is therefore an important object of the present invention to provide an electronic keyboard system which is simplified in the wiring arrangement.

It is also an important object of the present invention to provide an electronic keyboard system in which the electric signals are less liable to have the influence of the electromagnetic field.

To accomplish these objects, the present invention proposes to supply an electric current periodically changed in direction to a pair of light emitting diodes for selective illuminations.

In accordance with the present invention, there is provided an electronic keyboard system comprising (a) a keyboard having a plurality of keys extending over a plurality of octave scales, (b) a plurality of key sensor units respectively associated with the keys for detecting key motions thereof, and respectively having a plurality of light emitting elements, a plurality of photo sensing elements respectively provided in association with the light emitting elements and a plurality of shutter plates respectively fixed to the keys and movable into or out of respective gaps between the light emitting elements and the photo sensing elements, the light emitting elements being paired to form a plurality of sensing pairs, the sensing pairs being divided into a plurality of sensing groups, (c) sound producing means operative to produce sounds, and (d) a controlling unit having a plurality of bidirectional current driving units respectively coupled to the sensing groups through interconnections, and communicable with the photo sensing elements for causing the sound producing means to produce the sounds, in which the bidirectional current driving units periodically change the directions of currents on the interconnections, respectively, so as to selectively illuminate the light emitting elements.

BRIEF DESCRIPTION OF THE DRAWINGS

The features and advantages of an electronic keyboard system according to the present invention will be more clearly understood from the following description taken in conjunction with the accompanying drawings in which:

FIG. 10 is a bit map showing bit strings representative of pieces of key status information in a previous keyboard status file;

FIG. 11 is a bit map showing bit strings representative of pieces of key-on status information and pieces of key-off status information;

FIG. 14 is a bit map showing the relationship between the index variable and the control signals supplied to bidirectional current driver circuits.

DESCRIPTION OF THE PREFERRED EMBODIMENT

Figure 1:
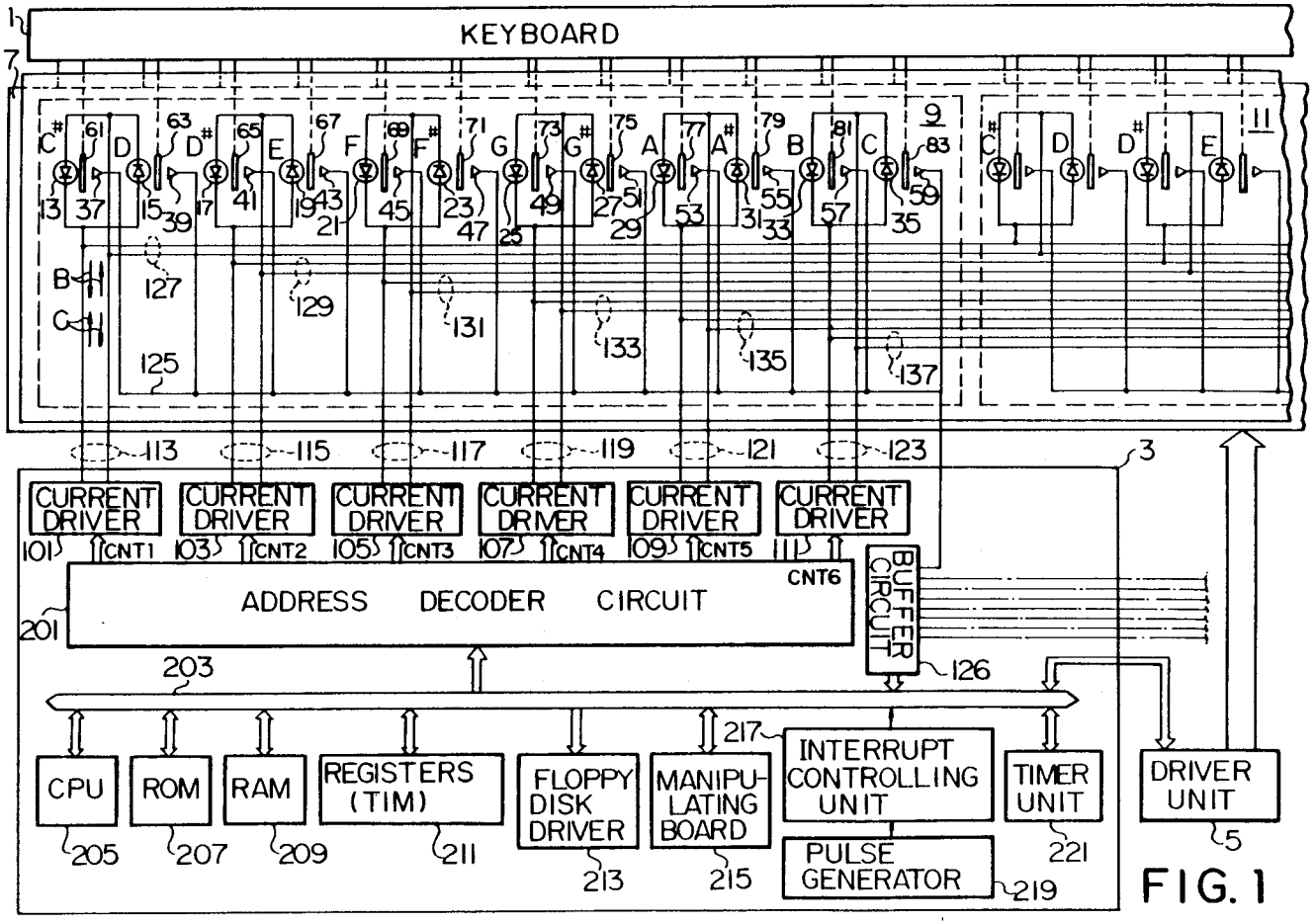
FIG. 1 is a block diagram showing the arrangement of an essential part of an electronic keyboard system embodying the present invention.

Referring first to FIG. 1 of the drawings, an electronic keyboard system according to the present invention largely comprises a keyboard 1 having a plurality of keys, a plurality of key sensor blocks, a controller unit 3 communicable with the key sensor blocks as well as a driver unit 5, and a key actuator unit 7. In this instance, the present invention appertains to the automatic player system. The electronic keyboard system has a playing mode of operation and a playback mode of operation. A player performs a music by a series of keying-in operations, and the controller unit 3 produces pieces of musical data information on the basis of the keying-in operations in the playing mode of operation. However, the controller unit 3 retrieves the pieces of the musical data information, and the driver unit 5 selectively actuates the key actuator unit 7, thereby reproducing the sounds of the music.

The keys are grouped by twelve to form a plurality of, typically, eight key blocks respectively assigned to octave scales, and the key blocks are respectively associated with the key sensor blocks. Although only two key sensor blocks 9 and 11 are shown in FIG. 1, eight key sensor blocks are provided for the keyboard 1. All of the key sensor blocks are similar in arrangement to one another, and, for this reason, description is made for the key sensor block 9 only for the sake of simplicity.

The key sensor block 9 comprises twelve light emitting diodes 13 to 35, twelve phototransistors 37 to 59 and twelve shutter plates 61 to 83, and the light emitting diodes 13 to 35 are paired with the phototransistors 37 to 59 and arranged in opposing relationship. Thus, the twelve light emitting diodes 13 to 35 and the twelve phototransistors 37 to 59 form in combination twelve photo-electric converting units, and an optical path takes place between each light emitting diode and the associated phototransistor. The twelve shutter plates 61 to 83 are movably inserted between the light emitting diodes 13 to 35 and the phototransistors 37 to 59, respectively, and are moved into or out of the photo-electric converting units depending upon the key states, respectively.

Figure 2:
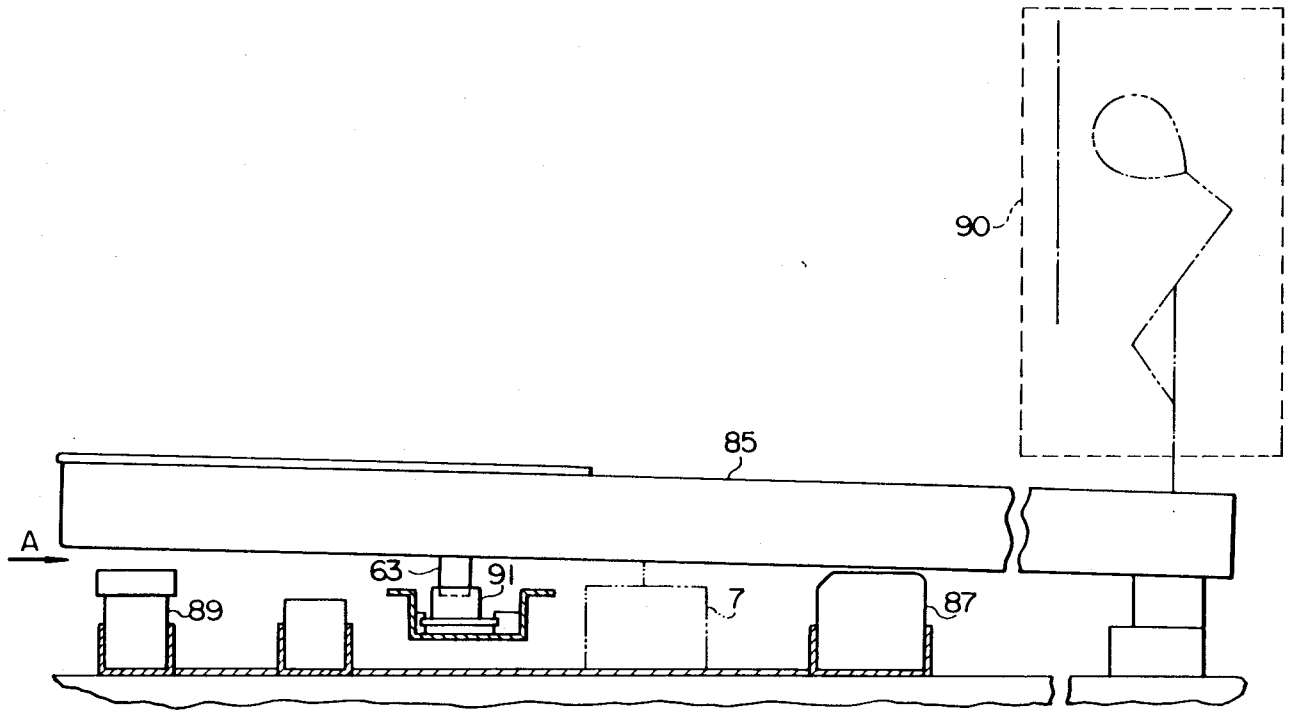
FIG. 2 is a side view showing one of the keys associated with the key sensor unit incorporated in the electronic keyboard system shown in FIG. 1.
Figure 3:
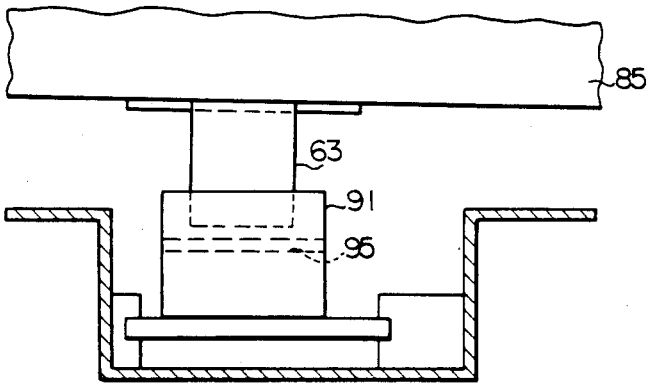
FIG. 3 is a side view showing, to an enlarged scale, the key sensor unit shown in FIG. 2.
Figure 4:
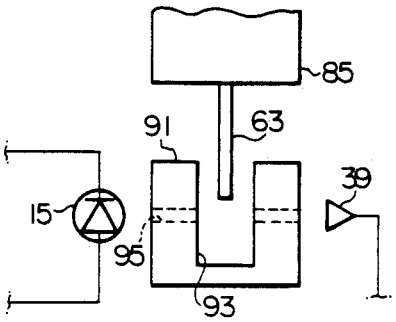
FIG. 4 is a front view showing the key sensor unit shown in the direction of arrow A of FIG. 2.

Turning to FIGS. 2 to 4, one of the keys of the key board 1 is shown in an enlarged scale, and is designated by reference numeral 85. The key 85 is, by way of example, provided in association with one of the shutter plates 63 which in turn is associated with the photo-electric converting unit formed by the combination of the light emitting diode 15 and the phototransistor 39. The key 85 is rockably supported by a balance rail 87, and the leading end of the key 85 is spaced apart from a front rail 89 in so far as no force is exerted on the top surface of the front end portion of the key 85. The key without any force is hereinbelow referred to as "non-depressed state".

The keyboard is further associated with a mechanical sound producing unit 90, and the mechanical sound producing unit 90 is provided with key action mechanisms, hammers and music wires as well known in the art, so that detailed description is omitted for the sake of simplicity. When the key 85 stays in the non-depressed state, the hammer is spaced apart from the associated music wire, so that no sound is produced by the mechanical sound producing unit 90. However, if the key 85 is depressed, the hammer strikes the associated music wire to produce a sound with note assigned to the depressed key 85. The actuator unit 7 is provided beneath the keyboard 1, and the actuator unit 7 is operable to pull the key or keys down upon actuation. This results in that the key is moved into the depressed state without keying-in operation by the player, thereby causing the mechanical sound producing unit 90 to produce the sound.

The shutter plate 63 is fixed to the back surface of the key 85, and a guide block 91 is provided between the light emitting diode 15 and the phototransistor 39. A slit 93 is formed in the guide block 91, and extends in the vertical direction. The guide block 91 is further formed with a conduit 95 extending in the lateral direction, and the conduit 95 is open at both side surfaces of the guide block 91. Both ends of the conduit 95 are faced to the light emitting diode 15 and the phototransistor 39, respectively, and, for this reason, the optical path passes through the conduit 95. While the key 85 stays in the non-depressed state, the light emitting diode 15 is coupled through the optical path to the phototransistor 39, because the leading end of the shutter plate 63 is lifted above the conduit 95. A current flows in the phototransistor 39, and an electric signal is produced with the current. However, when the key 85 is downwardly depressed and reaches a depressed state, the optical path is blocked by the shutter plate 63, and, accordingly, no current takes place in the phototransistor 39. Since the other shutter plates associated with the other photo-electric converting units are similar in construction to those illustrated in FIGS. 2 to 4, electric signals are produced in the phototransistors 37, and 41 to 59, respectively, upon depressing the associated keys. Each of the photo-electric converting units, each of the shutter plates and each of the guide blocks as a whole constitute a key sensor unit.

Turning back to FIG. 1, the light emitting diodes 13, 17, 21, 25, 29 and 33 are electrically coupled to the adjacent light emitting diodes 15, 19, 23, 27, 31 and 35 to form six loops, respectively, which in turn are coupled in parallel to bidirectional current driver units 101 to 111 through interconnection pair 113 to 123. The current driver units 101 to 111 respectively supply the loops with currents in either direction indicated by arrows B or arrows C. A single signal line 125 is shared by the phototransistors 37 to 59, and is coupled to a buffer circuit 127.

Figure 5:
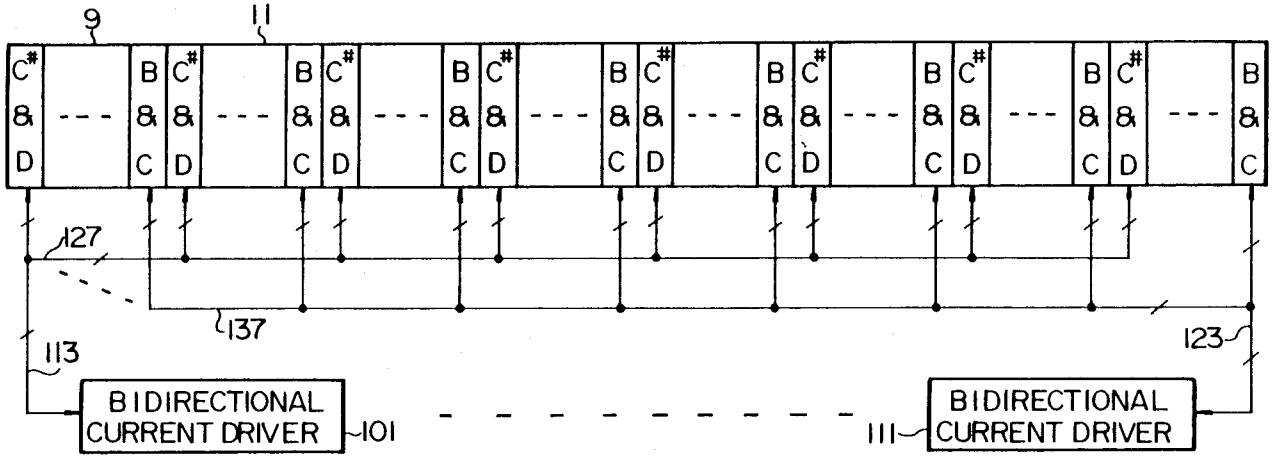
FIG. 5 is a block diagram showing, in a modeled form, the arrangement of the wirings interconnecting the key board and the controller incorporated in the electronic keyboard system shown in FIG. 1.
Figure 6:
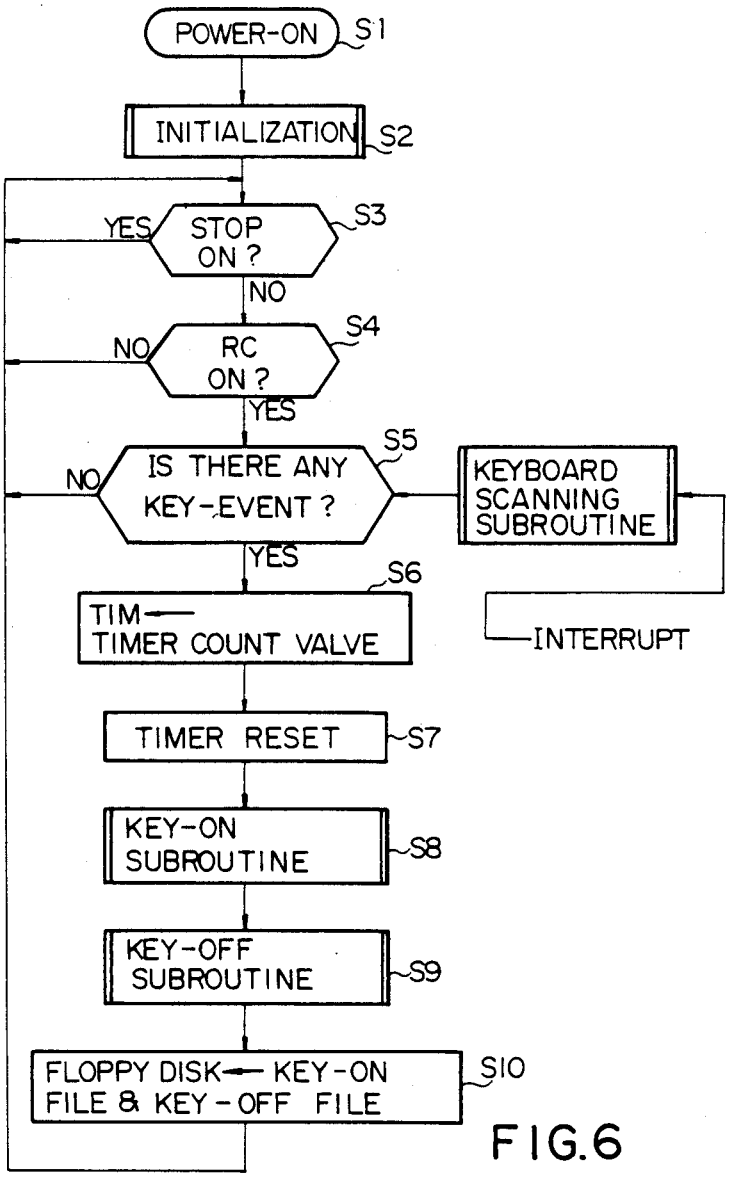
FIG. 6 is a flowchart showing the sequence of a main routine program executed by a microprocessor incorporated in the electronic keyboard system shown in FIG. 1.
Figure 7:
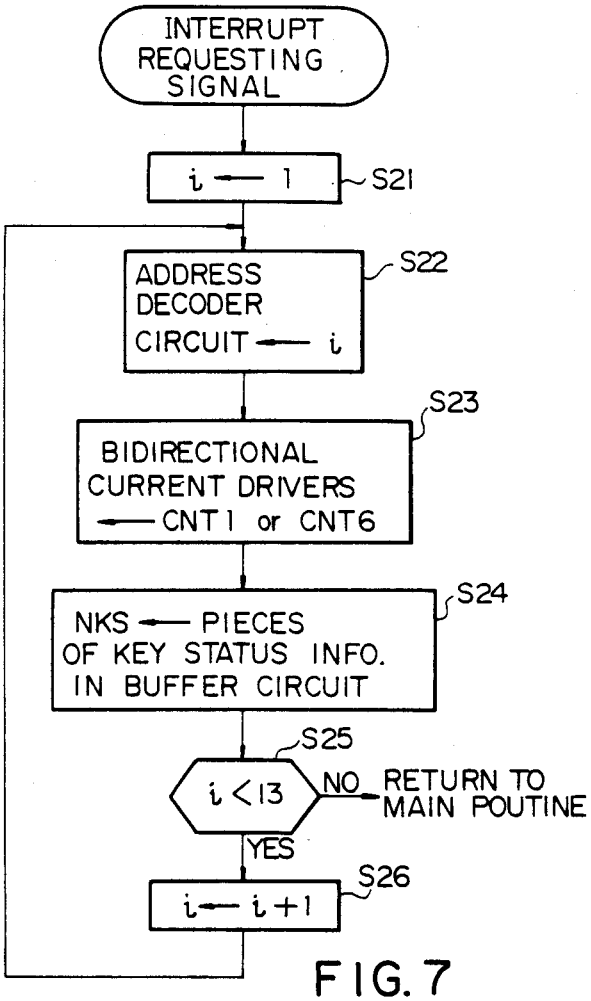
FIG. 7 is a flowchart showing the sequence of a keyboard scanning subroutine program periodically executed by the central processing unit.

As described hereinbefore, the eight key sensor blocks are incorporated in the electronic keyboard system, and are assigned to the eight octave scales, respectively. This means that the eight keys are assigned the same note, and, accordingly, twelve note groups are formed in the keyboard 1. In other words, the twelve note groups are represented by twelve note names C#, D, D#, E, F, F#, G, G#, A, A#, B and C, and all of the light emitting diodes associated with these keys are also grouped by the twelve node names. Since the light emitting diodes in each key sensor block are paired with the adjacent light emitting diodes in the same key sensor block to form the six loops, all of the light emitting diodes are grouped into six loop groups as illustrated in FIG. 5, and the light emitting diodes in the six loop groups L1 to L6 are coupled through six interconnection pairs 127 to 137, respectively. This results in that the six bidirectional current driver units 101 to 111 are coupled to the light emitting diodes of the six loop groups through the interconnection pairs 113 to 123 and further through the interconnection pairs 127 to 137, respectively.

If the current driver unit 101 supplies the current in the direction indicated by arrows B, the light emitting diode 13 and the light emitting diodes also grouped by the note name C♯ are concurrently illuminated, however, no light emission takes place in the light emitting diode 15 and the light emitting diodes identified by the note name D. If, on the other hand, the current driver circuit 101 changes the current from the direction indicated by arrows B to the direction indicated by arrows C, the light emitting diodes identified by the note name D are illuminated with the current, however, the light emitting diodes identified by the note name C♯ are kept silent. Thus, the single current driver unit selectively activates the light emitting diodes identified by two note names, and, for this reason, only six bidirectional current driver units 101 to 111 are provided in the controller 3. This results in a simple arrangement of the wirings, which in turn results in reduction is the occupation space. Moreover, the interconnections 113 to 123 and 127 to 137 are disposed to be spaced from one another, and, for this reason, electric signals on the interconnections are less liable to be under the influence of the electromagnetic field.

Turning back to FIG. 1, the controlling unit 3 further comprises an address decoder circuit 201 coupled to a multi-bit bus system 203, a central processing unit (, which is abbreviated as "CPU" in FIG. 1,) 205 sequentially fetching programmed instruction codes stored in a program memory formed by a read only memory 207 (abbreviated as "ROM" in FIG. 1), a working memory 209 formed by a random access memory (also abbreviated as "RAM" in FIG. 1), and registers 211, and the central processing unit 205, the program memory 207 and the working memory 209 are also coupled to the multi-bit bus system 203. The address decoder circuit 201 produces two-bit control signals CNT1 to CNT6, and the bidirectional current driver circuits 101 to 111 are responsive to the two-bit control signals to alternate the directions of the currents.

In the working memory 209 are defined a previous keyboard status file (, which is abbreviated as "OKS" in the drawings), a key-on file, a key-off file and so on, and pieces of key-on data information and pieces of data key-off information are temporally memorized in the key-on file and the key-off file, respectively. The pieces of the key-on data information and the pieces of the key-off data information form parts of the musical data information. However, a current keyboard status file (which is abbreviated as "NKS") is established in the registers 211. The current keyboard status file keeps pieces of key status information produced upon production of a current interrupt requesting signal, and the key previous keyboard status file provides the pieces of key status information established upon production of the previous interrupt requesting signal. The pieces of the key status information are indicative of the key states of the keys, i.e., the non-depressed state and the depressed state, respectively. The interrupt requesting signal is hereinbelow described.

The registers 211 are further provides respective storages for a timer count value and an index variable i. The index variable i is increased in value from 1 to 13, and the value of the index variable i is representative of one of the note names. Namely, the index variable i of "1" represents the note C♯, and the index variable i of "2" is representative of the note D. Thus, the note is successively identified by increasing the index variable i, and the index variable i of "12" is indicative of the note C. However, if the index variable has value of "13", the central processing unit 205 returns to the note C♯.

A floppy disk driver 213 is further coupled to the multi-bit bus system 203, and the pieces of the musical data information are memorized in a floppy disk in the floppy disk driver 213, and are, thereafter, retrieved in the playback mode of operation. On a manipulating board 215 are provided various switches which are coupled to the multi-bit bus system 203. The switches on the manipulating board 215 include a power-on switch, a mode selecting switch, a recording switch RC and a termination switch STOP, and the recording switch and the termination switch are alternatively turned on and off.

The controller unit 3 further comprises an interrupt controlling unit 217 associated with a pulse generator 219, and a timer unit 221. The interrupt controlling unit 217 counts the pulses supplied from the pulse generator 219, and periodically produces the interrupt requesting signal. The interrupt requesting signal is supplied from the interrupt controlling unit 217 through the bus system 203 to the central processing unit 205, and causes the central processing unit 205 to proceed to a key event detecting subroutine program. The timer unit 221 increments the timer count value, and the timer count value is memorized in one of the resisters TIM. The buffer circuit 126 is also coupled to the multi-bit bus system 203, and eight-bit detecting signal is supplied from the phototransisters and temporally memorized therein.

Description is hereinbelow made for operations of the electronic keyboard system with reference to FIGS. 6 to 9 on the assumption that the playing mode is established.

When the player operates the power-on switch, a main routine program starts at step S1, and the central processing unit 205 executes an initialization subroutine program at step S2 for providing initial values to the working memory 209, the registers 211 and the timer unit 221. When the initialization subroutine program is completed, the central processing unit 205 proceeds to step S3 and checks into the manipulating board 215 to see whether or not the termination switch STOP is actuated. If the answer to the step S3 is given in the positive, the central processing unit 205 repeats the step S3 until the answer to the step S3 is changed to the negative.

With the negative answer, the central processing unit 205 proceeds to step S4 and checks to see whether or not the recording switch is actuated. As described hereinbefore, the termination switch and the recording switch are alternatively turned on and off, so that the answer to the step S4 is given in the positive in so far as the answer to the step S3 is in the negative. However, if the answer to the step S4 is given in the negative, the central processing unit 205 returns to the step S3 and reiterates the loop between the steps S3 and S4.

With the positive answer, the central processing unit 205 proceeds to step S5, and decides whether or not there is any key event in the keyboard 1. The key event includes a key-on event and a key-off event, and the key-on event is produced upon depressing any key. On the other hand, the key-off event is produced upon releasement of the depressed key, so that the key event is causative of shifting the key between the depressed state and the non-depressed state. In the step S5, the central processing unit 205 compares the pieces of the key status information in the current keyboard status file NKS with the pieces of the key status information in the previous keyboard status file OKS. The current keyboard status file NKS and, accordingly, the previous keyboard status file OKS are rewritten in a key event detecting subroutine program which starts with the interrupt requesting signal, and, for this reason, the keyboard scanning subroutine program is described hereinbelow with reference to FIG. 7.

The interrupt controlling unit 217 counts the pulses supplied from the pulse generator 219, and produces the interrupt requesting signal when the number of the pulses reaches a predetermined value. In this instance, the interrupt controlling unit 217 produces the interrupt requesting signal at an interval of about several millisecond.

When the interrupt requesting signal is supplied to the central processing unit 205, the central processing unit 205 proceeds to step S21 to set the index variable i to the value of "1" as by step S21. Then, the central processing unit 205 proceeds to step S22 to transfer the index variable i of "1" to the address decoder circuit 201 as by step S22.

As described hereinbefore, the index variable i of "1" is representative of the note C#, and, for this reason, the address decoder circuit 201 provides the control signal CNT1 at step S23, and the bidirectional current driver circuit 101 supplies the current in the direction of arrows B to the interconnections 113. The current in the direction of arrows B allows not only the light emitting diode 13 but also the light emitting diodes associated with the keys assigned to the note C# to illuminate. The light emitting diodes thus illuminated produce the respective optical beams which pass through the respective conduits 95. If the keys stays in the non-depressed states, respectively, the optical beams reach the associated phototransistors 37, respectively, however, the keys in the depressed states interrupt the optical beams. With the optical beams, the phototransistors 37 produces the respective currents which are converted into data bits of "0", however, no current takes place without the optical beams and is converted to data bits of "1". These data bits are temporally stored in the buffer circuit 126, and form parts of the pieces of the key status information. The parts of the pieces of the key status information are transferred from the buffer circuit 126 to the current keyboard status file NKS in the registers 211 as by step S24.

Subsequently, the central processing unit 205 proceeds to step S25 and checks into the registers 211 to see whether or not the index variable i is less than value "13". If the answer to the step S25 is given in the negative, the central processing unit 205 returns to the main routine program, however, the central processing unit 205 proceeds to step S26 with the positive answer to the step S25 to increment the index variable i.

After the step S26, the central processing unit returns to the step S22 to transfer the index variable i of "2", and the address decoder circuit 201 produces the control signal CNT1 to cause the bidirectional current driver circuit 101 to supply the current in the direction of arrows C to the interconnections 113. The current in the direction of arrows C allows the light emitting diodes 15 associated with the keys assigned to the note D to illuminate, so that pieces of the key status information are produced in the buffer circuit 126 for the keys assigned to the note D. Thus, the central processing unit 205 increments the index variable i and stores the pieces of the key status information for all of the keys in the current keyboard status file NKS. When the index variable i reaches the final value of "13", all of the keys are checked to see whether the keys are in the non-depressed states or in the depressed states, and all the pieces of the key status information are rewritten into the current keyboard status file NKS.

Figures 8, 9:
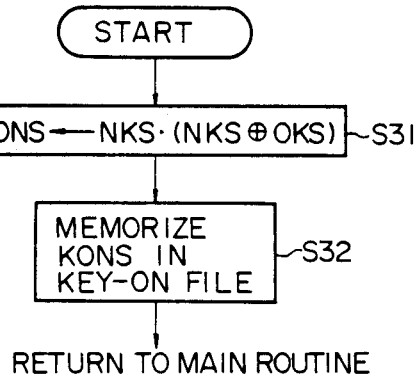
FIG. 8 is a bit map showing bit strings representative of pieces of key status information in a current keyboard status file.
FIG. 9 is a flowchart showing the sequence of a key-on subroutine program executed after a detection of a key event.

When the current keyboard status file NKS is thus built up, the bit strings of the pieces of the key status information are, by way of example, shown in FIG. 8. In FIG. 8, "NT" stands for "note", and "OCT" represents the octave scale. With the negative answer to the step S25, the central processing unit 205 returns to the step S5 of the main routine program.

As describing the behavior at the step S5, the central processing unit 205 successively fetches the pieces of the key status information in the current keyboard status file NKS, and compares them with the corresponding pieces of the key status information in the previous keyboard status file OKS. If no difference takes place between the piece of the key status information in the current keyboard status file NKS and the corresponding piece of the key status information in the previous keyboard status file OKS, the central processing unit 205 decides that any key event, i.e., the key-on event or the key-off event does not take place in the keyboard 1, and, for this reason, the answer to the step S5 is given in the negative. With the negative answer, the central processing unit 205 returns to the step S3, and reiterates the loop consisting of the steps S3 to S5 until any key event takes place in the keyboard.

If the player depresses or releases a key, the piece of the key status information in the current keyboard status file NKS is changed in the keyboard scanning subroutine program, and, for this reason, one of or some of the pieces of the key status information in the current keyboard file NKS are different from those in the previous keyboard status file. This results in the positive answer to the step S5. When the central processing unit 5 decides that any key event takes place in the keyboard 1, the timer count value is transferred from the timer unit 221 to the resister TIM as by step S6, and the central processing unit 205, thereafter, proceeds to step S7 to reset the timer unit 221.

After the step S7, the central processing unit executes a key-on subroutine program at step S8. The program sequence of the key-on subroutine program is illustrated in detail in FIG. 9.

Turning to FIG. 9 of the drawings, the key-on subroutine program S8 start with step S31, and the central processing unit 205 successively fetches the pieces of the key status information in the current keyboard status file NKS, and the pieces of the key status information are, then, exclusive-ORed with the pieces of the key status information in the previous keyboard status file OKS. If each piece of the key status information in the current keyboard status file NKS is identical in logic level with the corresponding piece of the key status information in the previous keyboard file OKS, the answer to the exclusive-OR operation is given in the logic "0" level, however, whenever the pieces of the key status information are different in logic level from one another, the answer is given in the logic "1" level.

After the exclusive-OR operation, the answer of the exclusive-OR operation is further ANDed with the piece of the key status information in the current keyboard status file NKS. Since the logic "1" is given to every piece of the key status information representative of the depressed state, the answer to the AND operation is given in the logic "1" level in so far as the key is shifted from the non-depressed state to the depressed state. For example, assuming now that FIG. 10 shows the bit strings of the pieces of the key status information in the previous keyboard file OKS, the exclusive-OR operations followed by the AND operations result in the bit strings shown in FIG. 11, and the bits in FIG. 11 represent pieces of key-on status information KONS. Namely, each of the bits of the logic "1" level encircled indicates that the key-on event takes place at the corresponding key. In this example, the key-on events take place at the keys assigned to the note F of the third octave and the note A# of the first octave, respectively. The pieces of the key-on status information KONS are transferred to the working memory 209 and used for formation of the key-on file as by step S32.

Figure 12:
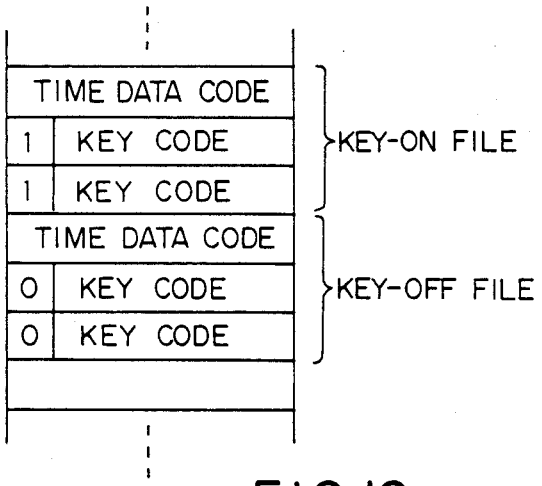
FIG. 12 shows a key-on file and a key-off file established by the central processing unit on the basis of the bit strings shown in FIG. 11.

The arrangement of the key-on file is illustrated in FIG. 12, and the key-on file has a time data code followed by key code or key codes. The time data code is representative of the timer count value stored in the register TIM. The timer unit 221 is reset to the initial value of "0" at the step S7, and the timer count value at the key event is memorized in the register TIM, so that the timer count value is indicative of the time interval between the key events. Then, the central processing unit 205 produces the time data code on the basis of the timer count value in the register TIM, and previously transfers the time data code to the working memory 209 for memorization in the key-on file. The key codes are representative of the keys in the keyboard 1, and the key codes in the key-on file indicate the keys in the depressed states, respectively.

Figure 13:
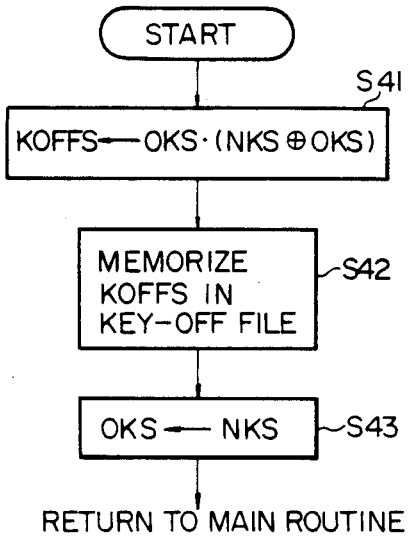
FIG. 13 is a flowchart showing the sequence of a key-off subroutine program executed after the detection of the key event.

After the completion of the key-on file, the central processing unit returns to the main routine program, and proceeds to step S9. In the step S9, the central processing unit 205 executes a key-off subroutine program the sequence of which is illustrated in FIG. 13 in detail.

The key-off subroutine program starts with step S41 where the central processing unit 205 successively fetches the pieces of the key status information in the current keyboard status file NKS. Each of the pieces of the key status information thus fetched is exclusive-ORed with the corresponding piece of the key status information in the previous keyboard file OKS, and the result of the exclusive-OR operation is further ANDed with the corresponding piece of the key status information in the previous keyboard file OKS. The exclusive-OR operations find the differences between the current keyboard file and the previous keyboard file, and the AND operations identify the keys shifted from the depressed states to the non-depressed states. Thus, the central processing unit 205 produces pieces of key-off status information through the exclusive-OR operations followed by the AND operations. For example, if the bit strings of the current keyboard status information and the previous keyboard status information are respectively shown in FIGS. 8 and 10, the bits of logic "1" without any circle in FIG. 11 are indicative of the key-off events. Namely, the keys assigned to the note D# of the second octave and the note F# of the third octave are released and shifted from the depressed states to the non-depressed states, respectively.

Thus, the pieces of the key-off status information are produced at the step S41, the central processing unit 205 proceeds to step S42 and transfers the pieces of the key-off status information to the working memory 209 to establish a key-off file. The key-off file is shown in FIG. 12, and is constituted by the time data code and the key codes. In order to place the time data code at the front position, the central processing unit 205 transfers the time data code from the register TIM to the working memory 209 again, and, then, memorizes the key codes representative of the note D# of the second octave and the note F# of the third octave.

After the completion of the key-off file, the central processing unit 205 proceed to step S43 and transfers the pieces of the key status information in the current keyboard file NKS to the previous keyboard file OKS. After the step S43, the central processing unit 205 returns to the main routine program and proceeds to step S10.

In the step S10, the central processing unit 205 transfers the key-on file and the key-off file to the floppy disk for recording, and, then, returns to the step S3. Thus, the central processing unit 205 reiterates the loop consisting of the steps S3 to S10 until the answer to the step S3 is given in the positive.

The key-on files and the key-off files thus recorded in the floppy disk are sequentially retrieved in the playback mode of operation, and the central processing unit 205 supplies the pieces of the key-on status information and the pieces of the key-off status information to the driver unit 5. With the pieces of the information, the driver unit 5 produces actuation signals which are supplied to the actuator unit 7 for selectively shifting the keys between the non-depressed states and the depressed states, thereby reproducing the sounds of the music.

As will be understood from the foregoing description, the wiring arrangement between the controller unit 3 and the key sensor blocks 9, 11, . . . are simplified by virtue of the bidirectional current driver circuits 101 to 111 which are supplied with the control signals CNT1 to CNT6 produced on the basis of the index variable i varied in value as shown in FIG. 14.

Although particular embodiment of the present invention have been shown and described, it will be obvious to those skilled in the art that various changes and modifications may be made without departing from the spirit and scope of the present invention. For example, if the electronic keyboard system has a tone generating unit, the controller 3 can communicate with the tone generating unit to synthesize sounds instead of the actuation of the actuator unit 7. Moreover, the key sensor units of the electronic keyboard system described above are used for detecting the key motions, i.e., the shifting motions only, however, if each of the key sensor units is dualized, key velocity are detectable. Namely, when a counter is provided in association with the dual key sensor units for measuring the time interval therebetween, the time interval is proportional to the key velocity, and, accordingly, pieces of key-touch information are produced thereon.

What is claimed is:

1. An electronic keyboard system comprising (a) a keyboard having a plurality of keys extending over a plurality of octave scales, (b) a plurality of key sensor units respectively associated with said keys for detecting key motions thereof, and respectively having a plurality of light emitting elements, a plurality of photo sensing elements respectively provided in association with the light emitting elements and a plurality of shutter plates respectively fixed to said keys and movable into or out of respective gaps between the light emitting elements and the photo sensing elements, said light emitting elements being paired to form a plurality of sensing pairs, said sensing pairs being divided into a plurality of sensing groups, (c) sound producing means operative to produce sounds; and (d) a controlling unit having a plurality of bidirectional current driving units respectively coupled to said sensing groups through interconnections, and communicable with said photo sensing elements for causing said sound producing means to produce said sounds, in which said bidirectional current driving units periodically change the directions of currents on said interconnections, respectively, so as to selectively illuminate said light emitting elements.

2. An electronic keyboard system as set forth in claim 1, in which said light emitting elements of each sensing pair respectively have input nodes and output nodes, and in which the input node of one of said light emitting elements is coupled to the output node of the other light emitting element, and the output node of aforesaid one of said light emitting elements is coupled to the input node of the other light emitting element, wherein each of said bidirectional current driving units has two output nodes coupled in parallel to the input nodes of said light emitting elements through said interconnections.

3. An electronic keyboard system as set forth in claim 2, in which the two output nodes of each bidirectional current driving units are further coupled in parallel to input nodes of said corresponding light emitting elements of the other sensing groups.

4. An electronic keyboard system as set forth in claim 3, in which said sound producing means have an actuator unit for producing said key motions without any depressing force of an player, and a mechanical sound producing unit actuated by said keys and mechanically producing said sound.

5. An electronic keyboard system as set forth in claim 3, in which said light emitting elements are formed by light emitting diodes, respectively, and in which said photo sensing elements are formed by phototransistors, respectively.

6. An electronic keyboard system as set forth in clam 3, in which each of said key sensor units further has a guide block provided between said light emitting element and said associated photo sensing element, and in which said guide block has a conduit allowing an optical beam produced between said light emitting element and said photo sensing element to pass therethrough, and a slit intersecting the conduit and allowing said shutter plate to move therein.

7. An electronic keyboard system comprising (a) a keyboard having a plurality of keys extending over a plurality of octave scales, said keys being divided into a plurality of key groups by note names of each of said octave scales, (b) a plurality of key sensor units respectively associated with said keys for detecting key motions thereof, and respectively having a plurality of light emitting diodes, a plurality of phototransistors respectively provided in association with the light emitting diodes, a plurality of guide blocks provided between the light emitting diodes and the phototransistors, respectively, and respectively having conduits allowing optical beams produced between the light emitting diodes and the phototransistors to pass therethrough, respectively, and a plurality of shutter plates respectively fixed to said keys and movable into said guide blocks to intersect said optical beams, respectively, said light emitting diodes being paired to form a plurality of diode pairs, said diode pairs associated with the keys of said respective key groups forming a plurality of diode groups, respectively, (c) sound producing means operative to produce sounds; and (d) a controlling unit having a plurality of bidirectional current driving units respectively coupled to said diode groups through interconnections, and communicable with said phototransistors for causing said sound producing means to produce said sounds, in which said light emitting diodes of each diode pair respectively have input nodes and output nodes, and in which the input node of one of said light emitting diodes is coupled to the output node of the other light emitting diode, and the output node of aforesaid one of said light emitting diodes is coupled to the input node of the other light emitting diode, wherein each of said bidirectional current driving units has two output nodes coupled in parallel to the input nodes of said light emitting elements through said interconnections, the two output nodes of each bidirectional current driving units being further coupled in parallel to input nodes of said corresponding light emitting diodes of the same diode group.

* * * * *